US008844419B2

(12) United States Patent
Walian

(10) Patent No.: US 8,844,419 B2
(45) Date of Patent: Sep. 30, 2014

(54) DEVICE FOR FORMING A GROOVE

(71) Applicant: Mueller Martini Holding AG, Hergiswil (CH)

(72) Inventor: Harald Walian, Newport News, VA (US)

(73) Assignee: Mueller Martini Holding AG, Hergiswil (CH)

( * ) Notice: Subject to any disclaimer, the term of this patent is extended or adjusted under 35 U.S.C. 154(b) by 0 days.

(21) Appl. No.: 13/939,846

(22) Filed: Jul. 11, 2013

(65) Prior Publication Data

US 2013/0291703 A1 Nov. 7, 2013

Related U.S. Application Data

(63) Continuation of application No. 12/470,847, filed on May 22, 2009, now abandoned.

(30) Foreign Application Priority Data

May 28, 2008 (EP) ..... 08157121

(51) Int. Cl.
*B26D 11/00* (2006.01)
*B26D 3/08* (2006.01)

(52) U.S. Cl.
USPC ..... 83/863; 83/884; 83/74

(58) Field of Classification Search
USPC ..... 83/861, 863, 864, 872, 883, 886, 331, 83/339, 72, 74, 13
See application file for complete search history.

(56) References Cited

U.S. PATENT DOCUMENTS

| | | | | |
|---|---|---|---|---|
| 2,485,020 A | | 10/1949 | Staude | |
| 2,496,468 A | * | 2/1950 | Hanson | 83/116 |
| 2,598,649 A | * | 5/1952 | Rintoul | 83/663 |
| 3,526,566 A | * | 9/1970 | McIlvain, Jr. et al. | 428/121 |
| 3,593,899 A | * | 7/1971 | DeTorre | 225/2 |
| 4,795,414 A | | 1/1989 | Blumle | |
| 5,133,235 A | | 7/1992 | DeVito | |

(Continued)

FOREIGN PATENT DOCUMENTS

| | | |
|---|---|---|
| EP | 0 627 303 A1 | 12/1994 |
| EP | 1 845 046 A1 | 10/2007 |

(Continued)

OTHER PUBLICATIONS

European Search Report dated Nov. 21, 2008, directed to counterpart EP 08157121.8 application No. (6 pages).

*Primary Examiner* — Sean Michalski
(74) *Attorney, Agent, or Firm* — Venable LLP; Robert Kinberg; Tamatane J. Aga

(57) ABSTRACT

A device for forming a groove in a cover, the device including a circular score anvil having a first axis and being rotatable in a first direction and a circular scoring knife having a second axis positioned parallel to the first axis and arranged radially opposite the circular score anvil to define a gap between the score anvil and the scoring knife. The scoring knife is rotatable in a second direction opposite to the first direction and comprises a scoring element having an edge region that is tapered to form a ridge toward a periphery of the element. The edge region includes an intermediate space that divides the edge region into two spaced apart knife edges. A groove is formed in the cover while moving through the gap by operative cooperation of the scoring knife and score anvil.

7 Claims, 7 Drawing Sheets

(56) References Cited

U.S. PATENT DOCUMENTS

| | | | | |
|---|---|---|---|---|
| 5,690,601 | A * | 11/1997 | Cummings et al. | 493/340 |
| 8,074,551 | B2 * | 12/2011 | Chae | 83/886 |
| 2011/0072951 | A1 * | 3/2011 | Caron | 83/886 |
| 2011/0308366 | A1 * | 12/2011 | Redd | 83/169 |
| 2012/0210842 | A1 * | 8/2012 | Brackley et al. | 83/880 |

FOREIGN PATENT DOCUMENTS

| | | | |
|---|---|---|---|
| GB | 286178 | | 3/1928 |
| JP | 60 154043 | | 8/1985 |
| JP | 62-261432 | A | 11/1987 |
| JP | 2001105512 | | 4/2001 |
| JP | 2007-277012 | A | 10/2007 |
| WO | WO-2004/073966 | A1 | 9/2004 |

* cited by examiner

DEVICE FOR FORMING A GROOVE

CROSS-REFERENCE TO RELATED APPLICATION

This application is a Continuation of U.S. patent application Ser. No. 12/470,847, filed May 22, 2009, which claims the priority of European Patent Application No. EP 08157121.8, filed on May 28, 2008, all of which are incorporated herein by reference.

BACKGROUND OF THE INVENTION

The invention relates to a device for forming a groove on a single-page or multi-page sheet or on a web of paper, plastic or metal, passing through an annular gap between two circular scoring elements that rotate in opposite directions around parallel axes, wherein one scoring element is embodied as a scoring knife that is tapered toward the edge region in the manner of a ridge and the opposite-arranged scoring element is embodied as a score anvil.

Devices of this type are disclosed, for example, in the European patent document EP 0 627 303 A1, WIPO patent document WO 2004/073966 A1 and European patent document EP 1 845 046 A1.

The European patent document EP 0 627 303 A1 discloses a rotary embossing machine that is provided for the continuous scoring of carton blanks with two counter-rotating cylinders, between which a carton blank is clamped in and conveyed. One of the cylinders is provided along the periphery with an outward projecting embossing profile, which reduces the cross section with increasing diameter during one or a plurality of phases. The second cylinder contains a circular groove that is positioned opposite the embossing profile of the first cylinder. The aforementioned embossing device is suitable for use with thicker products, but not with thin products such as covers for magazines or other types of printed products.

The WIPO patent document WO 2004/073966 A1 discloses a system, which can be used to score and perforate flat materials by affixing strips to a drum rotating around a first axis. The strips that project from the cylindrical surface of the drum engage in a wheel that rotates around a second axis and is provided with one or a plurality of grooves. The first and the second axis in this case are arranged parallel to each other. The material, composition and geometry of the one or a plurality of strips that can be attached to be detachable to the drum can differ. If the strips are made of plastic, as described, they are subject to heavy wear and tear and must be replaced regularly with new ones. To obtain an optimum groove or perforation in the flat materials to be processed, the strips must be attached to the drum circumference with extreme precision in an axial, as well as radial, direction, an operation that can be very time-consuming and involved.

Differences in the quality and types of materials, such as non-printed or printed sheets, signatures, or foils also result in different types of behavior during the processing. Thus, it is known that sensitive sheets have a tendency to tear or break when they are folded along deformations caused by scoring, in particular if individual printed sheets are used as casings for books, softcovers or the like. The scoring displaces and/or compresses the material, thus providing the materials or sheets that are scored with a bending location that functions as a hinge. If the contact pressure applied with the scoring knife is too high, the sheets or the web are cut either partially or completely. If the contact pressure is too low, the fold may deviate from the intended bending location after the scoring.

Scoring devices are also known where the bulge generated by the scoring knife, also called a scoring bulge, following the folding operation comes to rest either on the outside (positive scoring) or on the inside (negative scoring) between the legs of the folded sheet. To be able to process the broadest possible spectrum of sheets, scoring devices are known which can be fitted or retrofitted for the positive and negative scoring.

SUMMARY

It is an object of the present invention to create a device of the aforementioned type, which permits an easy and careful scoring of even sensitive sheets.

The above and other objects are accomplished according to one aspect of the invention where there is provided a device for forming a groove in a cover, the device including a circular score anvil having a first axis and being rotatable in a first direction, and a circular scoring knife having a second axis positioned parallel to the first axis and arranged radially opposite the circular score anvil to define a gap between the score anvil and the scoring knife. The scoring knife is rotatable in a second direction opposite to the first direction and comprises a scoring element having an edge region that is tapered to form a ridge toward a periphery of the element. The edge region includes an intermediate space that divides the edge region into two spaced apart knife edges. A groove is formed in the cover while moving through the gap by operative cooperation of the scoring knife and score anvil.

In one embodiment, grooves formed by the two scoring knives can be positioned close enough, so that following the scoring and folding operation, the groove appears to be generated with a single scoring knife when viewed with the naked eye.

In another embodiment, the knife edges are advantageously designed to have an acute angle, so that a precise scoring operation can be realized. The acute angle for the knife edges is obtained in that the edge region, which is tapered in the manner of a ridge, is formed by an intermediate space.

In a further embodiment, the intermediate space can be a groove having side surfaces that are oriented parallel to each other and perpendicular to the axes.

In one embodiment, the two knife edges can respectively be rounded off with a radius, which allows a careful compressing and/or displacement of the material.

In another embodiment, to further influence the scoring surface of the groove, the score anvil can be provided with an indentation facing the scoring knife.

In a further embodiment, the indentation can furthermore be designed to accommodate an insert, for example an insert made of an elastic material.

Also conceivable is the use of a ring which operates jointly with the scoring knife and is mounted on the cylindrical outside surface of the score anvil.

In one embodiment, the scoring knife is positioned on a sensing wheel, which is pressed with an adjustable force against the score anvil, as shown in the European patent document EP 1 845 046 A1. The spacing between the two knife edges of the scoring knife and the score anvil is kept constant by the sensing wheel, regardless of the rotation of the score anvil, thus ensuring that the depth of a groove scored with the scoring knife in a sheet remains constant, regardless of the sheet thickness. If the scoring knife is furthermore connected with an eccentric connection to the sensing wheel, as shown in the European patent document EP 1 845 046 A1, the scoring depth can be adjusted very easily by turning this connection. An adjustment is necessary only during the changeover from very thin to very thick sheets or multi-page materials and vice versa.

In another embodiment, when folding a sheet along the deformation generated with the scoring knife, the fibers of a sheet are respectively bent by approximately 90° for each of the closely adjacent scoring grooves. With a scoring knife according to the prior art, having a single knife edge, the legs of the sheet that are bent by about 180° have a clearly higher tendency to tear or break. This unexpected and surprising effect achieved with the spaced-apart knife edges illustrates that the scoring device according to the invention is extremely tolerant and user-friendly with respect to adjusting the scoring depth and the contact pressure.

According to a further embodiment, the scoring knife can have a two-part design or a multipart design, meaning the axial distance between the side surfaces of the groove or between the knife edges can be adjusted, which allows the processing of an even broader product spectrum.

In one embodiment, the scoring device is used in a folder feeder for a gathering and stitching machine. In the process, unfolded sheets, especially protective covers, are pulled from a stack and are supplied with the aid of a feeding device to the scoring or folding device and are subsequently deposited on a sheet stack that is conveyed while positioned straddling on a saddle.

In another embodiment, the device can furthermore be used for generating a plurality of grooves in covers designed for adhesive-bound printed products. In the process, two grooves are normally produced for the precise alignment of the bending locations on the spine of the adhesive bound printed products or one or more decorative grooves are produced for opening up the casing on a book. Along the path where the casings are separated, on the way to a book block that is clamped into a perfect binder, the casings move through one or more scoring devices while positioned flat on a conveying device.

According to a further embodiment, a casing positioned flat on a table can be scored by moving the scoring knife across the stationary sheet. In that case, the table functions as score anvil provided with an elastic insert, at least in the region in which the scoring knife can score the material.

BRIEF DESCRIPTION OF THE DRAWINGS

The present invention will be more readily understood from the following detailed description when read in conjunction with the accompanying drawings, in which.

DETAILED DESCRIPTION

Figure 1B:
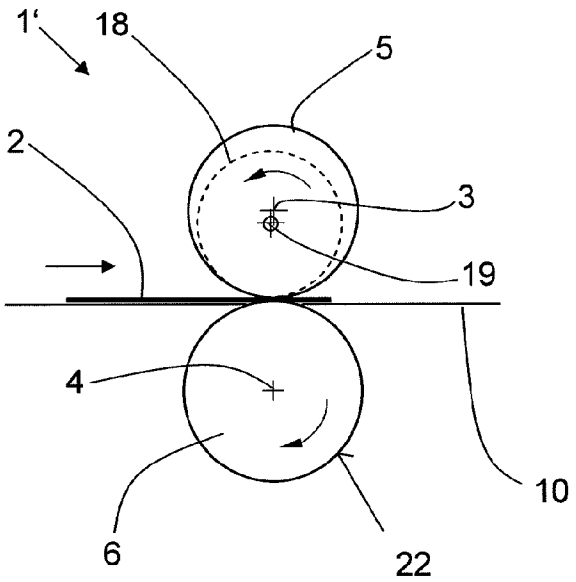
Fig. 1b (PRIOR ART)
FIG. 1*b* is a schematic representation of a scoring device in a book-binding machine according to the prior art.
Figure 1A:
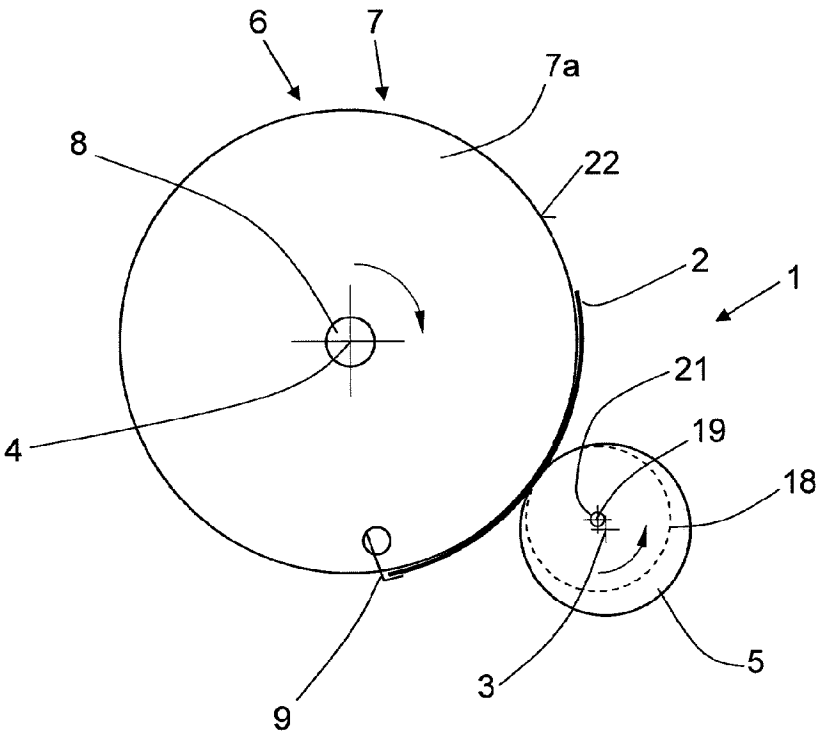
Fig. 1a (PRIOR ART)
FIG. 1*a* is a schematic representation of a scoring device in a folder feeder according to the prior art.

FIGS. 1*a* and 1*b* schematically show a device 1 and 1', respectively, for the scoring of material in the form of a single-page or multi-page sheets or a web of paper, plastic or metal. In the following, these different products and materials, either imprinted or not imprinted, are referred to as a cover 2. The device 1, 1' consists of at least two scoring elements that rotate around parallel axes 3, 4. A first scoring element is embodied as a scoring knife 5 while a second scoring element is embodied as a score anvil 6. FIG. 1*a* shows a cover 2, which is pulled from a stack that is not shown herein and is conveyed in clockwise direction with the aid of a drum 7 connected to the shaft 8. The drum 7 consists of at least two spaced-apart drum discs (only one drum disc 7*a* being shown), provided along the periphery with respectively at least one gripper 9 for holding the covers 2. The score anvil 6 can be a component of a drum disc or can be mounted between these drum discs on the shaft 8. It is advantageous if the drum disc and the score anvil 6 have at least approximately the same diameter. The cover 2 is scored during the conveying operation while it moves through the annular gap formed by the score anvil 6 and the scoring knife 5. The European patent document EP 1 845 046 A1 discloses the configuration of a folder feeder with a folding device to which the covers 2 are supplied.

It is furthermore conceivable for the diameter of the scoring knife to be nearly the same as that of the two drum discs and for the scoring knife to be attached to the shaft 8, for example between the drum discs, so that it can be driven around the axis 4. Accordingly, the score anvil can have a smaller diameter and can be pressed with an adjustable spring force against the scoring knife.

FIG. 1*b* schematically illustrates the device 1' for scoring covers 2 that are positioned flat on a conveyor 10 and can be used, for example, in a perfect binding system. In the process, the covers 2 are withdrawn in a manner known per se from a stack, not shown herein, or they are cut directly from a web, are scored, folded and supplied to the adhesive-covered spine of a book block. It is standard practice to use two or more pairs, consisting of score anvils 6 and scoring knives 5, for scoring the cover 2 so that a plurality of spaced-apart and parallel grooves are created. FIG. 1*b* shows that the scoring knife 5 is arranged above and the score anvil 6 is arranged below the plane in which the covers 2 are conveyed. However, it is also conceivable to exchange the positions of individual pairs of scoring elements or of all scoring element pairs.

Figure 2:
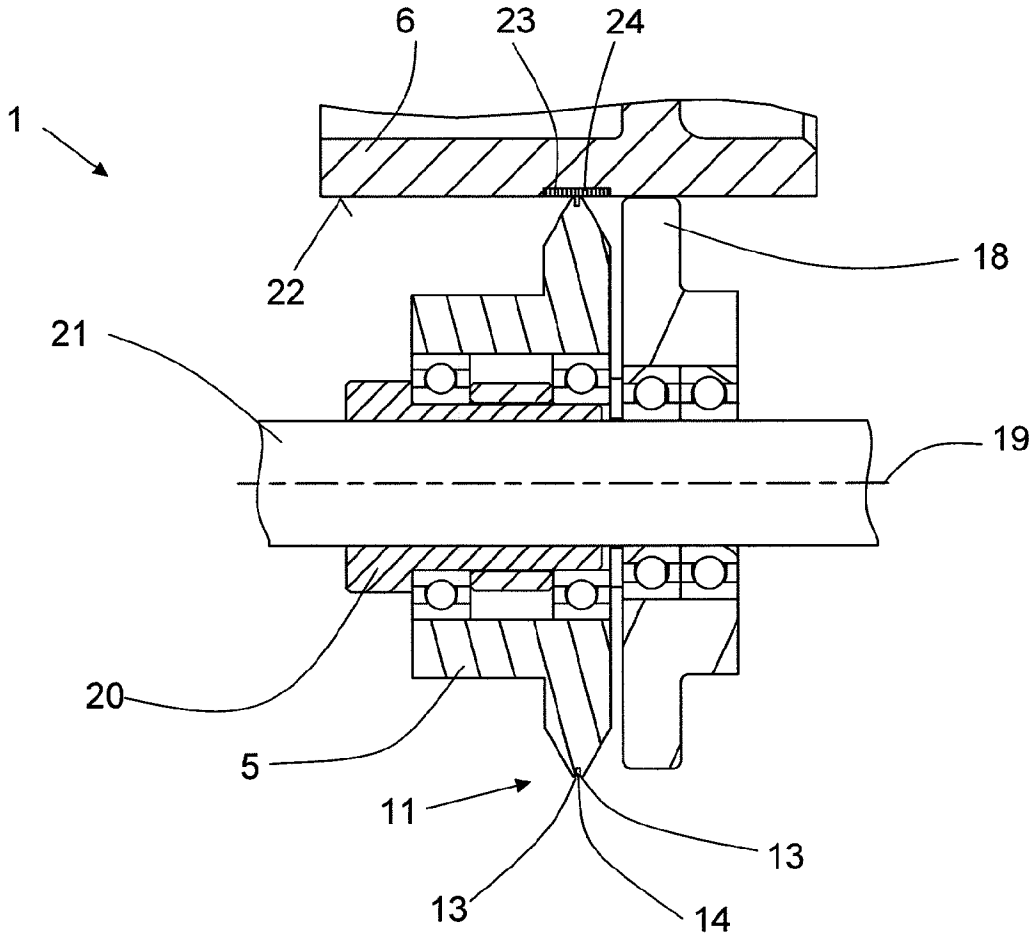
FIG. 2 is a cross sectional view of a device according to the invention.
Figure 3:
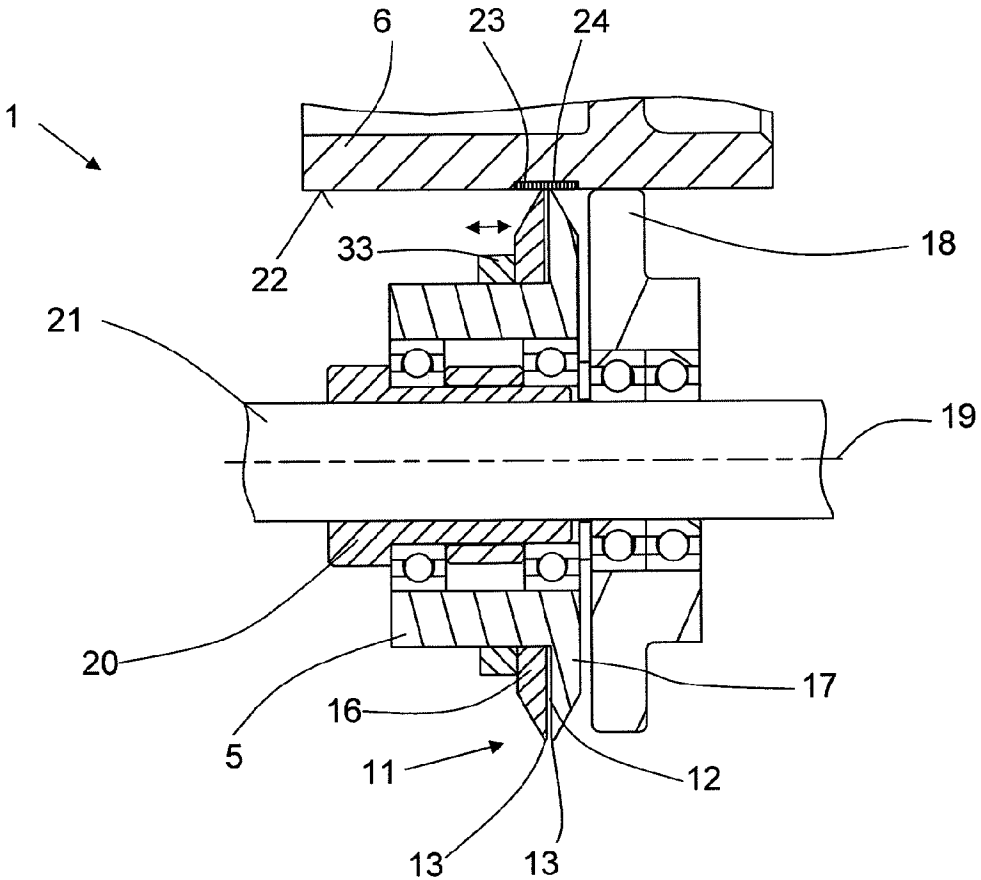
FIG. 3 is a cross sectional view of a variant of a device according to the invention, comprising a multipart scoring knife.

The edge region 11 of the scoring knife 5 is tapered toward the periphery, for example as shown in FIG. 2. An intermediate space 12 divides the edge region 11 into two spaced-apart knife edges 13. The knife edges 13 are embodied with an acute angle and are spaced apart axially by approximately 0.2 to 1 mm, for example by 0.4 to 0.6 mm. The intermediate space 12 can be formed by a circumferential groove extending in the edge region 11, such that the two side surfaces 15 of the groove 14 are oriented parallel to each other and perpendicular to the axis 3. The depth of the groove 14 corresponds at least approximately to its width, wherein a groove 14 embodied with a depth of 1 mm or more is advantageous. It is furthermore conceivable that the groove 14 is deep enough, so that the scoring knife 5 can be embodied in two parts, as shown in FIG. 3, wherein each of the two knife parts 16, 17 is provided with one of the two knife edges 13. By displacing one or both knife parts 16, 17 in the axial direction, the spacing between the knife edges 13 can be changed. The knife part 16, for example, can be secured in place in the axial direction with a fastening element 33.

The single-part or multi-part scoring knife 5 is positioned rotating on an eccentric bushing 20, which is securely connected to an immovable shaft 21. A sensing wheel 18, which is positioned adjacent to the scoring knife 5 on the shaft 21 and can rotate around an axis 19 is disclosed in European patent document EP 1 845 046 A1. This scoring knife is pressed with an adjustable spring force against the score anvil 6. It is advantageous if the diameter of the scoring knife 5 is at least equal to or larger than the diameter of the sensing wheel 18. By turning the shaft 21, the spacing between the knife edges 13 of the scoring knife 5 and the score anvil 6 can be changed and adjusted as a result of the eccentric connection between the scoring knife 5 and the sensing wheel 18.

It is furthermore conceivable that the spacing between the axis 4 for the score anvil and the axis 3 for the scoring knife is adjusted, for example via a thread, so that a sensing wheel and therewith associated elements can be omitted. The connection between the scoring elements can be embodied rigid or flexible.

Figures 4A, 4B, 4C, 4D:
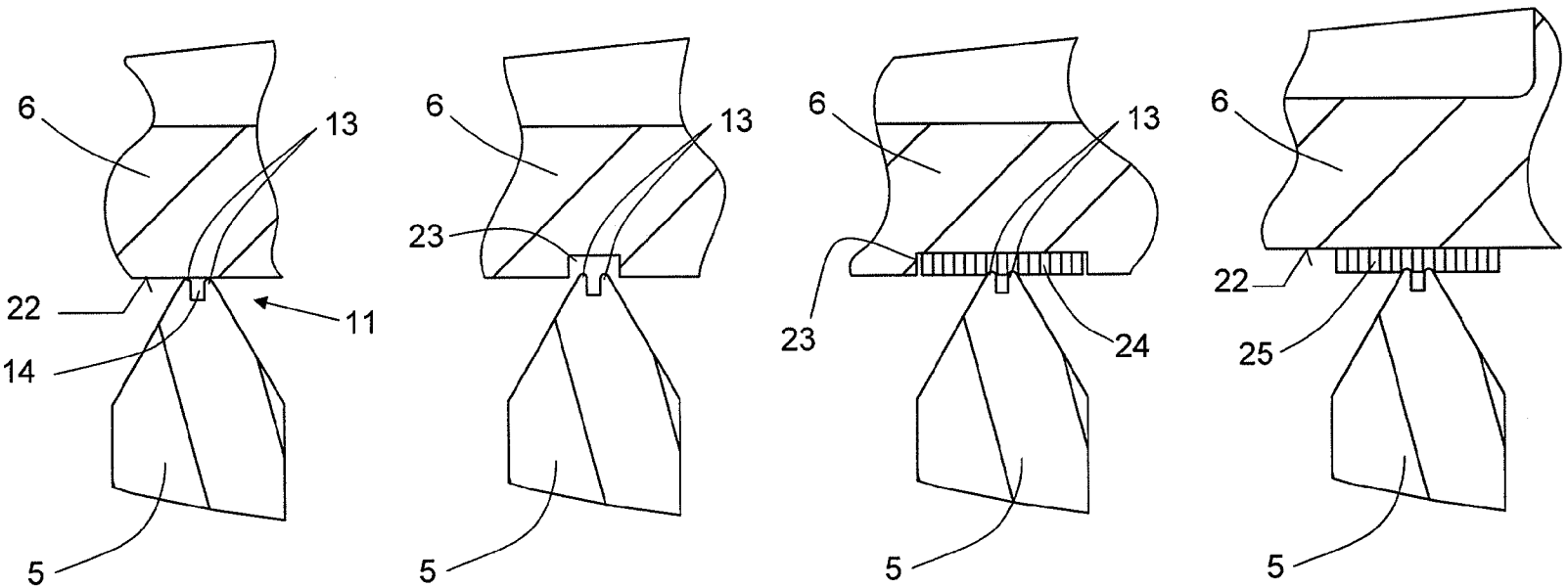
FIG. 4*a* is a detail showing the region of the knife edges for the scoring knife and the score anvil according to FIG. 2.
FIG. 4*b* is a variant according to FIG. 4*a;*
FIG. 4*c* is a variant according to FIG. 4*a;*
FIG. 4*d* is a variant according to FIG. 4*a;*

FIGS. 4*a* to 4*d* show an enlarged detail from FIG. 2. These figures respectively show the edge region 11 of the scoring knife 5 with the two knife edges 13, as well as the score anvil 6. FIG. 4*a* shows a score anvil 6 with a continuous cylindrical surface 22 in the region of the scoring knife 5 and the knife edges 13. In FIG. 4*b*, the score anvil 6 is provided along the periphery with an indentation 23 that faces the scoring knife 5. A cover that is conveyed between the scoring elements can thus be pushed into the indentation 23 by the knife edges 13.

Figure 5:
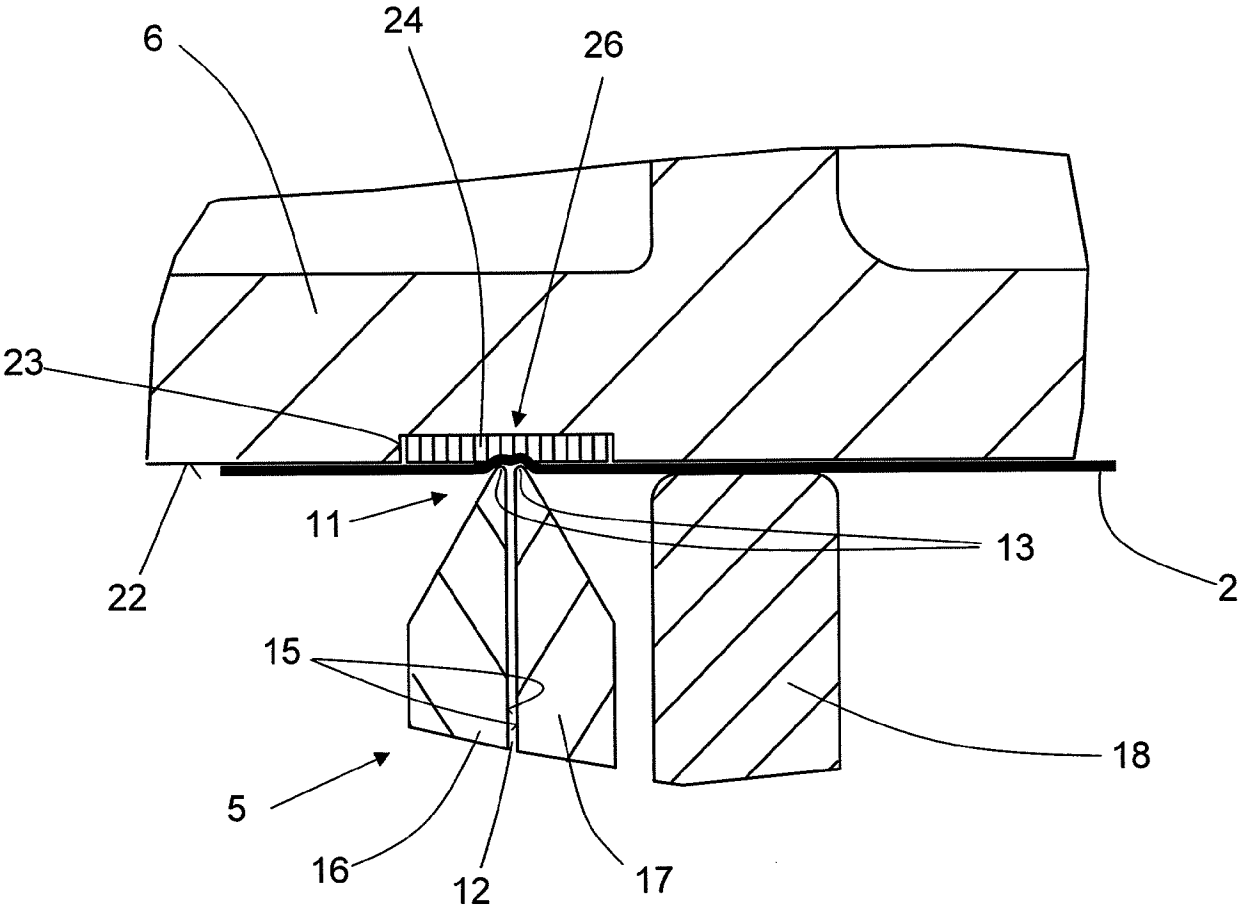
FIG. 5 is a detail of the scoring device shown in FIG. 2, with a printed sheet.
Figure 7B:
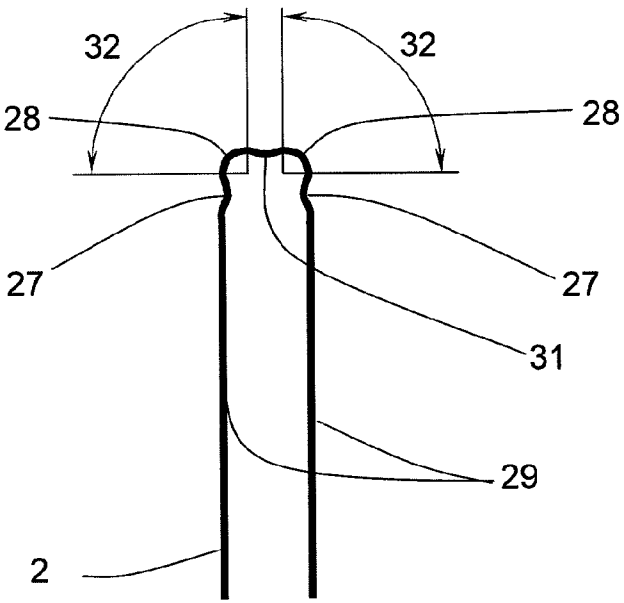
FIG. 7*b* depicts the printed sheet according to FIG. 7*a* after it is folded along the scoring line.
Figure 7A:
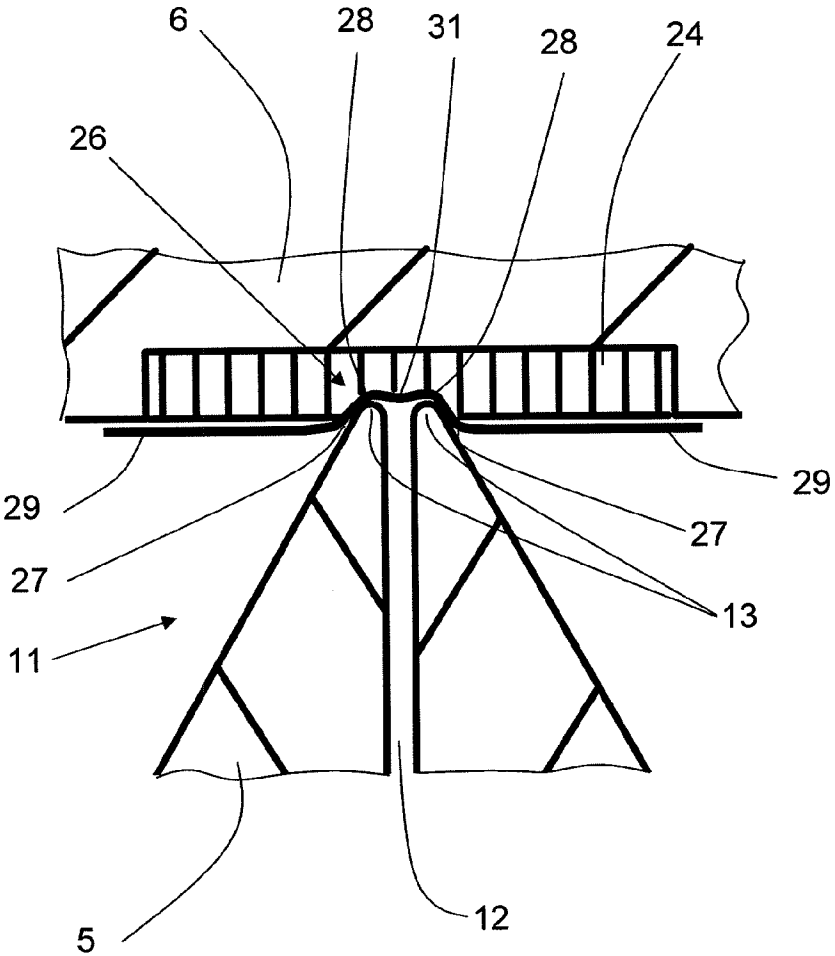
FIG. 7*a* depicts the edge region of a scoring knife according to the invention, with a printed sheet.

As shown in FIG. 4*c*, an insert 24 is inserted into the indentation 23 and supports the cover 2 during the scoring operation, on the side facing away from the scoring knife. It is particularly advantageous if the insert 24 is embodied to be flexible, at least in the radial direction. As a result of the insert 24, the covers 2 are provided with a scored groove 26 in the form as shown in FIG. 5 or 7*a*, for example, which is described in the following. The scoring depth can be adjusted by turning the shaft 21 and the bushing 20 connected thereto. That is to say, it is possible to optionally adjust the force exerted by the knife edges 13 for pressing the cover 2 into the insert 24 in the score anvil or for deforming and compressing the cover 2.

The insert 24 can be replaced for adapting to different covers 2 or because of wear and tear. To take into account the different characteristics of the covers 2, inserts 24 can be used which are produced from different types of plastic materials or rubber mixtures, thus making it possible to achieve an optimum scoring result even for extremely sensitive covers 2. The inserts 24 can be provided with a removable adhesive or they can be at least partially magnetic to permit an easy replacement.

If the material for the insert 24 is too hard or if the pressing force of the scoring knife 5 against the score anvil 6 is too strong, then the covers 2 can be cut either partially or completely, which is not desirable. If the insert 24 is too soft or the pressing force not strong enough, the groove 26 is not shaped well enough and the material at the bending locations is not sufficiently compressed.

Instead of using an insert 24 in the indentation 23, it is also conceivable to have an annular and elastic bulge 25 in the region of the scoring knife 5, as shown in FIG. 4*d*, which is affixed to the surface 22 of the score anvil.

FIG. 5 shows how a cover 2 passing through between the scoring elements 5, 6 is scored. For this, the sensing wheel 18 respectively moves on the score anvil 6 and the cover 2, which is pressed against the cylindrical surface 22 of the score anvil 6 with the pressing force exerted by the sensing wheel 18. The scoring knife 5 rotates passively around the axis 3 as the result of the contact between the edge region 11 with the insert 24 and the cover 2.

Figure 6B:
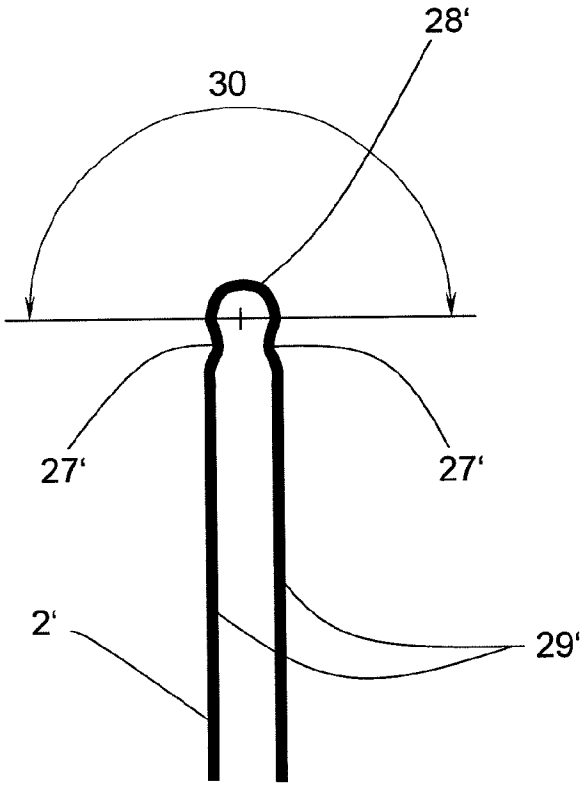
FIG. 6*b* depicts the printed sheet according to FIG. 6*a*, after it is folded along the groove.
Figure 6A:
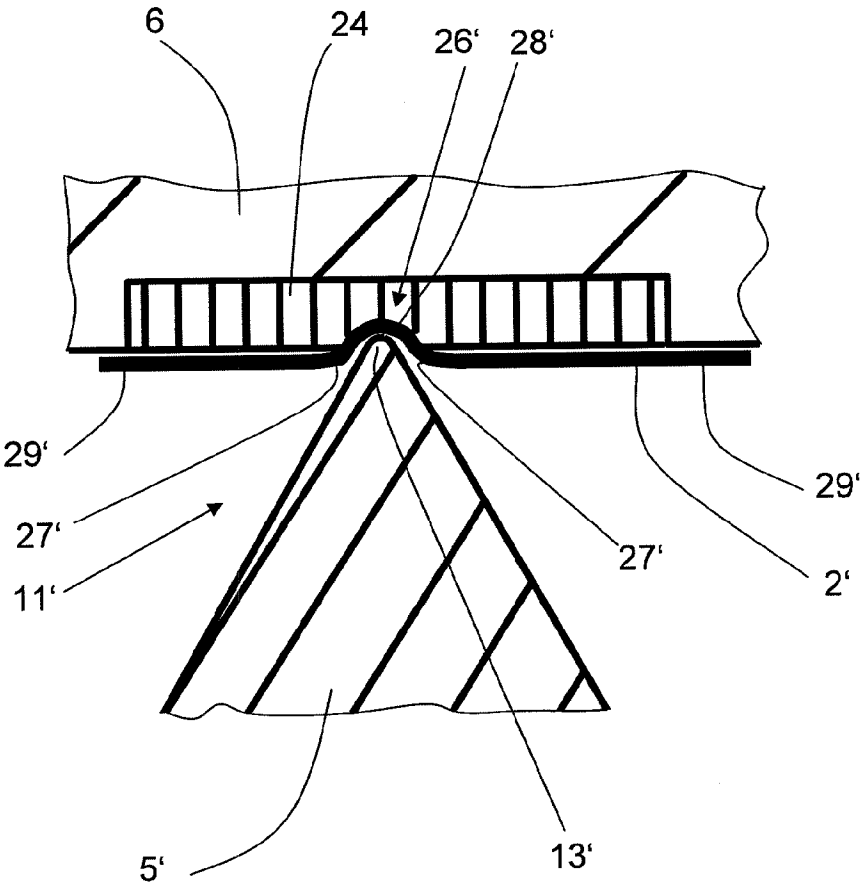
Fig. 6a (PRIOR ART)
FIG. 6*a* depicts the edge region of a scoring knife according to the prior art, with a printed sheet.

FIG. 6*a* shows a detail of an edge region 11' on a scoring knife 5' according to the prior art, wherein this scoring knife 5' has only one knife edge 13' along the periphery which cooperates with an insert 24 in the score anvil 6 that faces the knife edge. The knife edge 13' generates an groove 26' on a cover 2, with a first bend 27' that is influenced by the geometry of the knife edge 13'. On each side of the first bend 27' respectively one additional bend 28' is created, which connects the groove 26' with legs 29' of the cover 2', of which only sections are shown herein. The shape of the bends 27' is influenced by the characteristics of the cover 2' and the material used for the insert 24, as well as the contact pressure exerted by the scoring knife 5' and the scoring depth. With a hard insert 24, the bends 27' have a relatively small radius.

If the cover 2' that is scored as shown in FIG. 6*a* is folded, then its spine can be shaped as shown in FIG. 6*b*. Covers of this type are used, for example, for products processed in a gathering and stitching machine. The two legs 29' extend nearly parallel to each other. The fibers of the cover 2' are bent by an angle 30 in the bend 28' that is located between the bends 27'. Scored grooves produced according to the prior art have an angle 30 of approximately 180°. The stack of sheets to be gathered and stitched before being combined with the cover is not shown in FIG. 6*a*.

FIG. 7*a* shows the same detail as FIG. 6*a*, but with a scoring knife 5 according to the invention. In contrast to FIGS. 4*a* to 4*d*, the intermediate space 12 that divides the edge region 11 of the scoring knife 5 into two knife edges 13 is embodied herein as a deep groove and the scoring knife 5 has a two-part design. The scoring groove 26 differs from the scoring groove 26' shown in FIG. 6*a* in that an additional bend 31 is created between the two bends 28, formed by the two knife edges 13, as a result of the counter pressure exerted by the insert 24. For example, if an extremely soft insert 24 is used, the shape of the additional bend 31 approaches a straight line. With a relatively hard insert 24, the insert presses the sheet deeper into the intermediate space 12 between the knife edges 13, thus forming the bend 31 with a smaller radius. Following the folding operation, as described in the above, the fibers in the cover 2 are respectively bent by an angle 32 in the region of the bend 28. The angle 32 is noticeably smaller than the angle 30 shown in FIG. 6*b* and can be approximately 90°. As a result, the fibers have a clearly lower tendency to break and the covers 2 have a lower tendency to tear than with a scoring operation according to the prior art.

The geometry of the edge region 11 on the scoring knife 5 is not limited to rotating scoring elements. Beam-type scoring tools on known beam-type scoring machines can also be embodied with two knife edges disposed close to each other for forming a single scoring groove 26.

It will be understood that the above description of the present invention is susceptible to various modifications, changes and adaptations, and that the same are intended to be comprehended within the meaning and range of equivalents of the appended claims.

What is claimed is:

1. A device for forming a groove in a cover, comprising:

a circular score anvil having a first axis and being rotatable in a first direction; and a circular scoring knife having a second axis positioned parallel to the first axis and arranged radially opposite the score anvil to define a gap between the score anvil and the scoring knife, the scoring knife being rotatable in a second direction opposite to the first direction and comprising a scoring element having an edge region and two knife parts including knife edges in the edge region, wherein the edge region includes an intermediate space that divides the edge region into two spaced apart knife edges, the edge region being tapered to form a ridge toward a periphery of the scoring element, wherein at least one knife part is axially displaceable relative to the other knife part to define the intermediate space in the edge region between the knife edges that is variable from 0.2 mm to 1.0 mm;

wherein the score anvil includes a flexible element along a periphery facing the scoring knife to cooperate with the knife edges; and wherein the cover is supported during a scoring operation by the flexible element.

2. The device according to claim 1, wherein the knife edges comprise an acute angle.

3. The device according to claim 1, wherein the flexible element comprises an insert disposed in an indentation of the score anvil to cooperate with the scoring knife.

4. The device according to claim 3, wherein the scoring knife rotates passively around the axis as the result of contact between the edge region with the insert and the cover.

5. The device according to claim 1, wherein the flexible element comprises an annular and elastic bulge affixed to a surface of the score anvil in a region of the scoring knife.

6. The device according to claim 1, wherein the flexible element is made of a material having a hardness to permit the two spaced apart knife edges to form two bends on the cover and to form an additional bend between the two bends as a result of counter pressure exerted by the flexible element.

7. The device according to claim 1, further comprising a sensing wheel to support the scoring knife on the score anvil.

* * * * *